US007303422B2

(12) United States Patent
Hoffer et al.

(10) Patent No.: US 7,303,422 B2
(45) Date of Patent: Dec. 4, 2007

(54) IMPLANTABLE MODULAR, MULTI-CHANNEL CONNECTOR SYSTEM FOR NERVE SIGNAL SENSING AND ELECTRICAL STIMULATION APPLICATIONS

(75) Inventors: Joaquin Andres Hoffer, Anmore (CA); Gary B. Jenne, Aldergrove (CA)

(73) Assignee: Neurostream Technologies, Port Coquitlam (CA)

( * ) Notice: Subject to any disclaimer, the term of this patent is extended or adjusted under 35 U.S.C. 154(b) by 0 days.

(21) Appl. No.: 10/861,323

(22) Filed: Jun. 3, 2004

(65) Prior Publication Data

US 2005/0118887 A1 Jun. 2, 2005

Related U.S. Application Data

(60) Provisional application No. 60/475,982, filed on Jun. 4, 2003.

(51) Int. Cl.
*H01R 13/62* (2006.01)

(52) U.S. Cl. ..... 439/359; 439/367; 439/909; 607/37

(58) Field of Classification Search ..... 439/810, 439/359, 411, 412, 417, 909, 495, 499, 364, 439/367; 607/37
See application file for complete search history.

(56) References Cited

U.S. PATENT DOCUMENTS

| | | | | |
|---|---|---|---|---|
| 4,495,917 | A * | 1/1985 | Byers | 439/909 |
| 4,526,432 | A * | 7/1985 | Cronin et al. | 439/499 |
| 5,755,743 | A * | 5/1998 | Volz et al. | 607/37 |
| 6,129,747 | A | 10/2000 | Lindegren | |
| 6,198,969 | B1 | 3/2001 | Kuzma | |
| 6,321,126 | B1 | 11/2001 | Kuzma | |

* cited by examiner

*Primary Examiner*—Felix Figueroa
(74) *Attorney, Agent, or Firm*—Seyfarth Shaw LLP

(57) ABSTRACT

An implantable electrical connector includes a male portion and a female receptacle. The male portion includes a number of wires that terminate in a pattern of conductive areas. The male portion is inserted into a female receptacle and guides in the female receptacle limit the insertion of the male portion to a single direction. A locking mechanism such as a setscrew on the female receptacle forces conductive areas of the exposed conductors onto connecting pins within the female receptacle. The setscrew itself is electrically isolated from the conductive areas. Each pin in the female receptacle is surrounded by a rigid seal that engages a compressible insulating member under compression of the locking mechanism to prevent an electrical connection forming between adjacent pins in the connector.

25 Claims, 6 Drawing Sheets

IMPLANTABLE MODULAR, MULTI-CHANNEL CONNECTOR SYSTEM FOR NERVE SIGNAL SENSING AND ELECTRICAL STIMULATION APPLICATIONS

CROSS-REFERENCE(S) TO RELATED APPLICATION(S)

This application claims the benefit of U.S. Provisional Patent Application No. 60/475,982, filed Jun. 4, 2003, which is hereby incorporated by reference.

FIELD OF THE INVENTION

The present invention relates to medical devices in general and to implantable electrical connectors in particular.

BACKGROUND OF THE INVENTION

With many surgically implanted medical devices, it is necessary to transmit electrical signals that are sensed at a remote location and carried over a flexible wire to the device as well as to deliver electrical control signals or electrical stimulation signals produced at the device to a remote location in the body via flexible wires. Furthermore, it is often necessary or desirable that a variety of configurations of sensing and stimulating components be detachable from the implanted control unit, in particular so that the control unit or individual sensors or electrodes may be replaced as needed in subsequent surgeries. Therefore, most implantable medical devices include some sort of connector that serves as the bridge between the internal electronics of the control unit and the wires that connect the control unit to the remotely located sensors, electrodes or antennae. These connectors are often complex miniature devices and a frequent source of system failure. Reasons for connector failures may include misalignment between conductive elements, breakage of conductive elements or insulation elements, corrosion, or electrical shorts produced by fluid paths. In implantable connector designs with set screws that make direct electrical contact with electrodes it is often difficult to provide good electrical isolation from surrounding body fluids and in such cases, electrostatic discharges could damage excitable tissues and/or the implanted electronics. Therefore, there is a need for a connector for use with an implanted multi-channel device that allows reliable electrical connections between the device and a plurality of individual conducting wires while maintaining good electrical isolation between electrodes and bodily fluids. In addition, the connector should ensure that cross-talk or contamination of electrical signals between two or more channels of the connector is minimized. The electrical connector should be as small as possible while allowing a simple and secure connection during initial implantation and/or subsequent replacement of the control unit or of a detachable component.

SUMMARY OF THE INVENTION

The present invention is a modular, multi-channel implantable connector that provides high electrical isolation from body fluids and between channels and is therefore particularly well suited for nerve signal sensing and electrical stimulation applications. The connector includes a male portion and a female receptacle into which the male portion can be inserted. The female receptacle is a modular unit that is easily incorporated into a header portion of an implantable medical device housed in a hermetically sealed case. Cooperating features and an end-stop guide the insertion of the male portion into the female receptacle. A retaining screw on the female receptacle permits quick and secure installation or removal of the male portion from the female receptacle by the surgeon. The setscrew itself is electrically isolated from the conductive areas. The connector design is well suited for both stimulating and biological signal sensing electrodes such as nerve cuff electrodes, for implanted artificial sensors, and also for implanted antennae used for power transmission or communication with an external device.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF A PREFERRED EMBODIMENT

Figure 1:
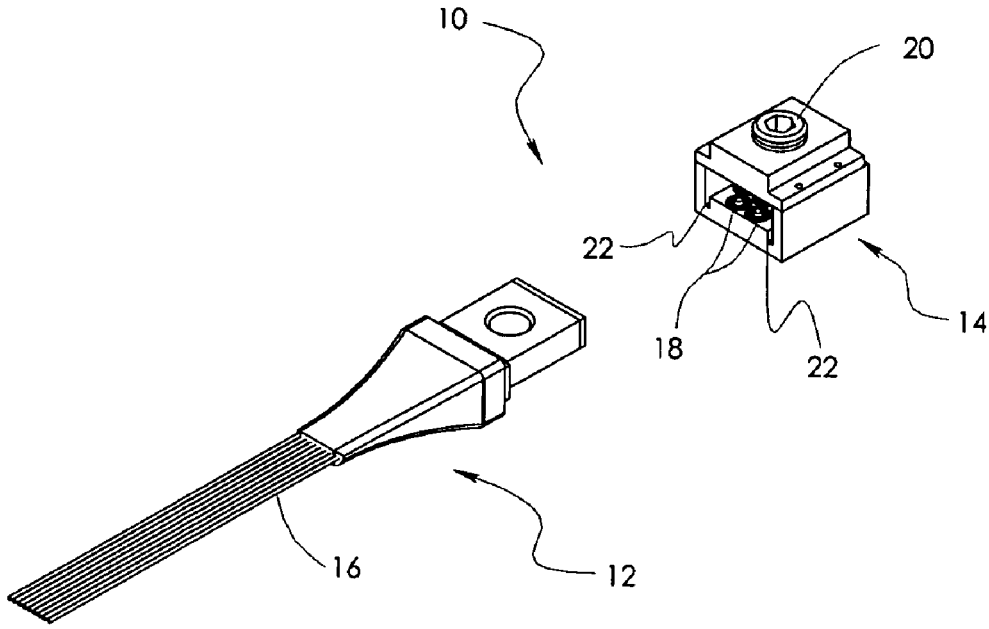
FIG. 1 illustrates an implantable electrical connector in accordance with one embodiment of the present invention.

FIG. 1 illustrates a multi-channel, implantable electrical connector in accordance with an embodiment of the present invention. The electrical connector system 10 includes a male portion 12 and a female receptacle 14. A plurality of individually insulated electrical conductors 16 terminate within the male portion 12. The male portion 12 is insertable into the female receptacle 14 such that a plurality of electrical pins 18 within the female receptacle 14 engage locally de-insulated portions (not visible) of the individually insulated conductors 16 within the male portion 12 in order to form independent electrical connections therebetween. The female receptacle 14 includes a pair of guides 22 that cooperate with corresponding fins (not visible) on the male portion 12 such that the male portion 12 remains correctly aligned and cannot be inserted incorrectly into the female receptacle 14. A setscrew 20 on the female receptacle 14 secures the male portion 12 within the female receptacle 14 such that the male portion 12 cannot disengage from the female receptacle 14.

Figure 2:
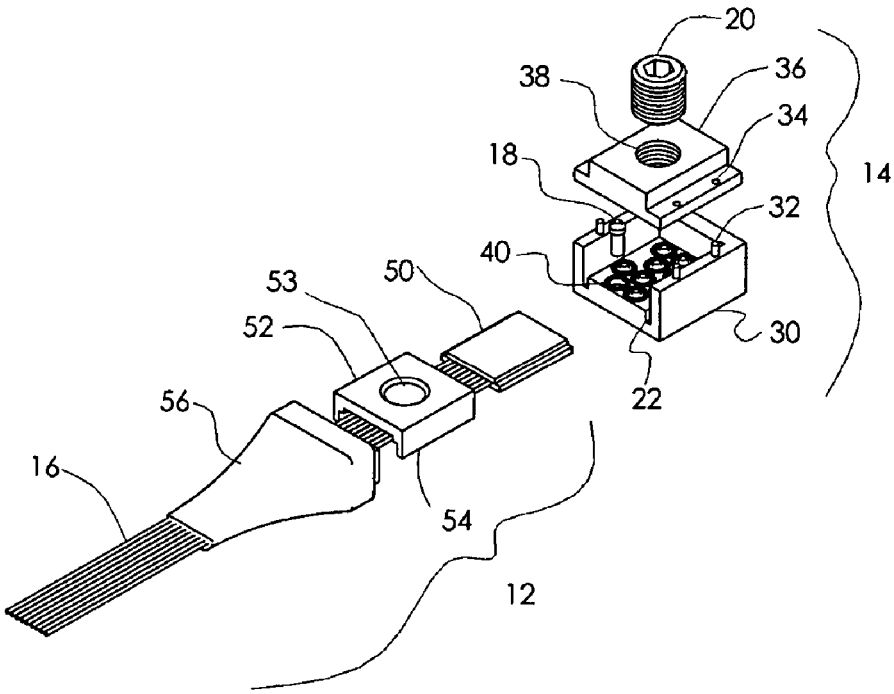
FIG. 2 illustrates an exploded view of a female receptacle and a male portion of the electrical connector shown in FIG. 1.

Turning to FIG. 2, the female receptacle 14 is formed of a generally square housing 30 made of rigid non-conducting material and having a bottom surface, three closed sidewalls, an open front side and an open top. A number of pins 32 extend from the top surface of the closed sidewalls to be received in corresponding holes 34 of a receptacle cap 36 that is made of rigid material and permanently bonded to the top of the housing 30. The setscrew 20 fits within a threaded hole 38 in the receptacle cap 36 in order to secure the male portion 12 within the female receptacle 14, as will be described in further detail below. A number of conductive pins 18 are seated in a pattern of holes 40 on the bottom surface of the square housing 30 of the female receptacle 14 and extend beyond the bottom surface of square housing 30 to provide electrical junction points to conventional feed-through wires that are embedded in the header portion of the device and connect to the electronics housed in a hermetically sealed case inside the implantable medical device. Each hole 40 is surrounded by an electrically isolating seal, as will be explained in further detail below, to prevent continuity between fluids that may seep inside the connector housing. The guides 22 extend along either side of the inside of the bottom surface of the housing 30 and ensure alignment of the male portion 12 within the female receptacle 14.

The male portion 12 includes a connector core 50 in which the ends of the individual conductors 16 terminate. The connector core 50 fits within a connector housing 52. The connector housing 52 is a generally U-shaped member made of rigid material and having a pair of downwardly extending fins 54 that cooperate with the guides 22 of the female receptacle 14 in order to guide the male portion 12 into the female receptacle 14. The connector housing 52 includes an indentation 53 that receives the set screw 20 and further ensures good electrical contact and correct alignment of the male portion and the female receptacle. A strain relief 56 covers the electrical leads 16 where they enter to the male portion 12.

Figure 3A:
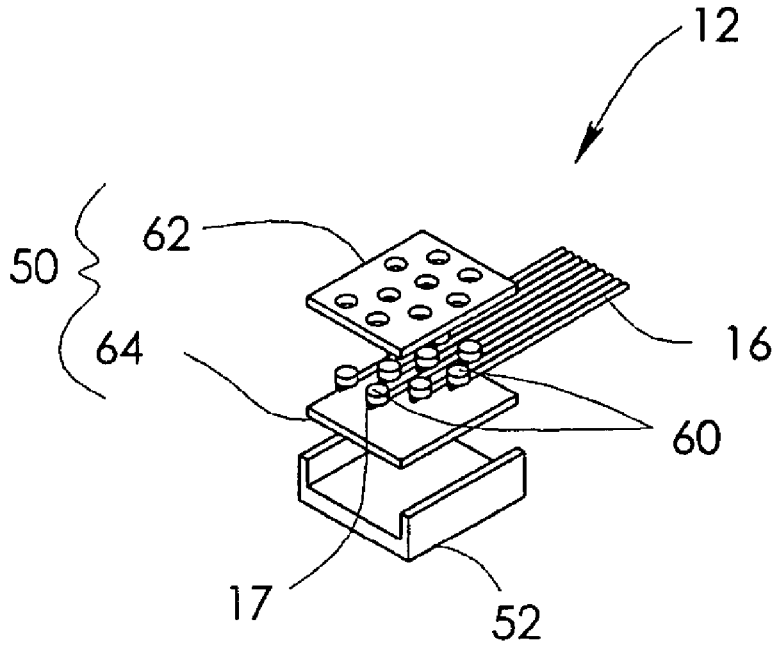
FIGS. 3A and 3B illustrate the construction of one embodiment of a male portion of the electrical connector.
Figure 3B:
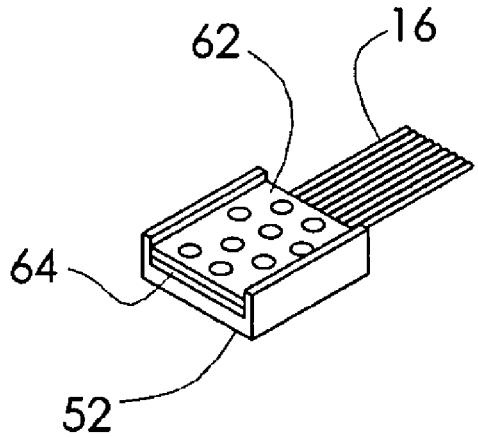

FIGS. 3A and 3B show further detail of the connector housing 52 and connector core 50 of the male portion 12. In this embodiment, small metal disks or pads 60 are attached to each of the insulated wire conductors 16 over a de-insulated region of the conductor wire 17. The conductors 17 terminate under each pad and do not extend to the front of the connector. The insulated wire conductors 16 and attached pads 60 are then bonded between two sheets of an elastomeric material such as silicone 62, 64. In this embodiment, the two sheets of elastomeric material 62, 64 together comprise the connector core 50 shown in FIG. 2. One sheet 62 is laser cut with openings for the pads 60. The assembly is then bonded to the rigid connector housing 52. The spacings of the pads 60 are staggered to form a two-dimensional pattern whereby the pads for adjacent conductors do not touch each other. The elastomeric sheet 64 separates the back surface of the pads 60 from the rigid connector housing 52.

Figure 4A:
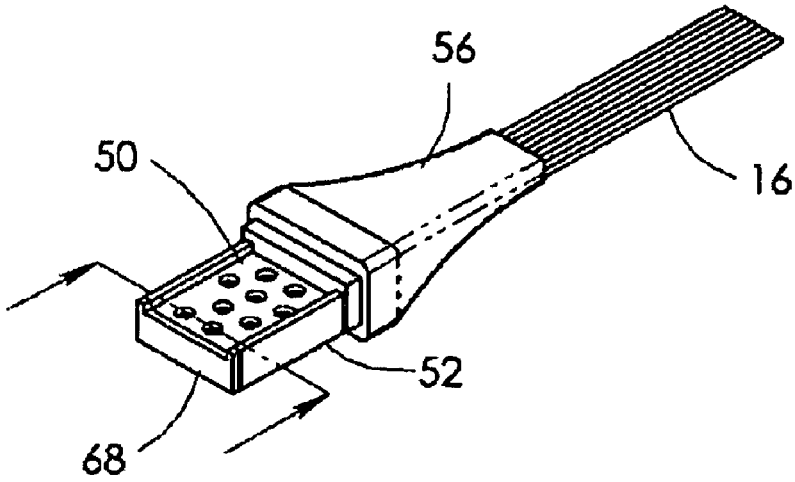
FIGS. 4A and 4B illustrate an alternative construction of the male portion of the electrical connector shown in FIGS. 3A and 3B.
Figure 4B:
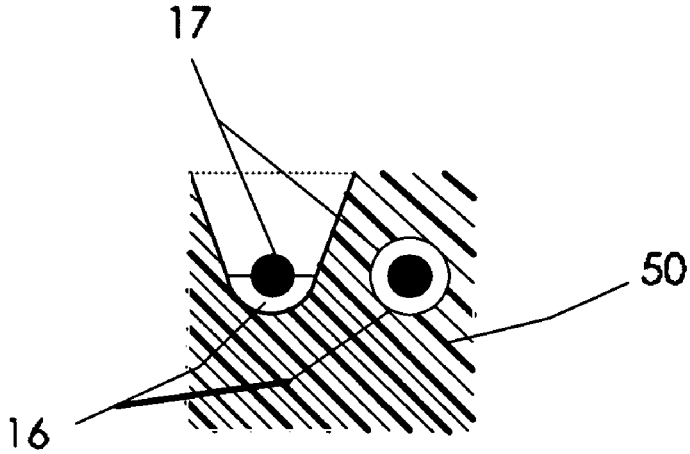

An alternative design and method of manufacture for the male portion of the connector is shown in FIGS. 4A and 4B. In this embodiment, the individually insulated conductor wires are encapsulated in a silicone connector core 50 and the connector core 50 is bonded to the connector male portion housing 52. The insulated wire leads extend the full length of the connector male portion and are cut to length during manufacture. In this version, a front seal 68, preferably made of silicone, is used to encapsulate and insulate the wire ends. A laser is used to locally remove portions of connector core 50 and the underlying wire insulation 16 in order to controllably expose each conductor 17 at a selected point to correspond to a contact area inside the female receptacle. In this configuration, direct contact is made between the de-insulated conductor lead 17 in the male portion and the contact 18 in the female receptacle. A strain relief 56 is over-molded between the connector portion and the individually insulated flexible conductors 16.

Figure 5:
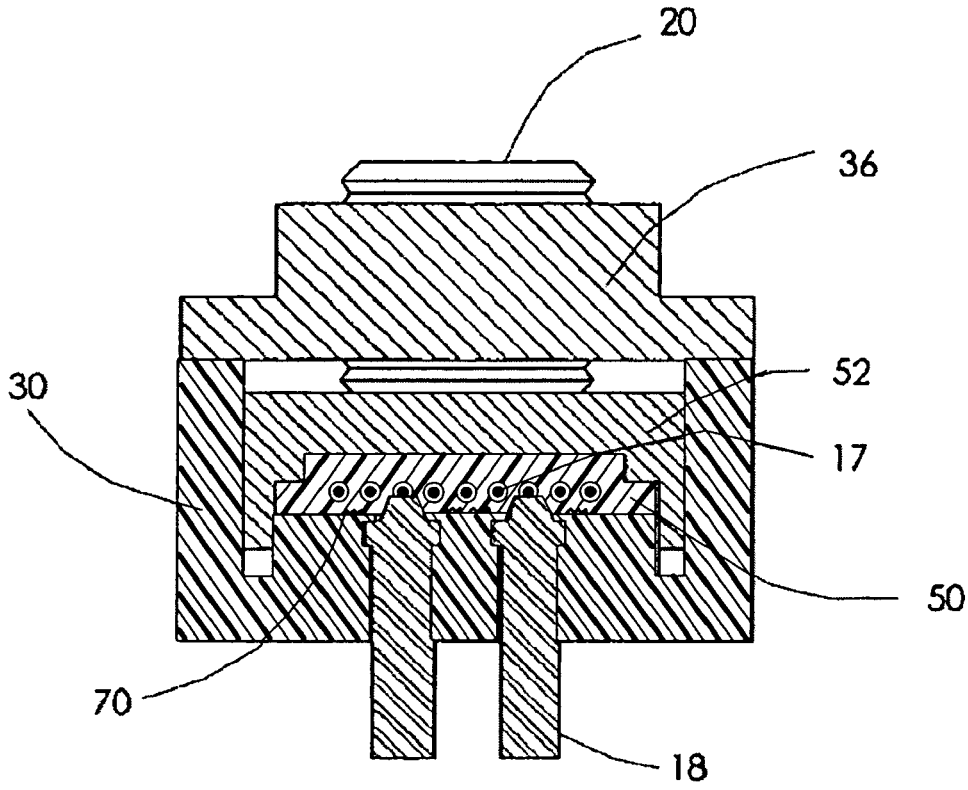
FIG. 5 is a cross-sectional view of the male portion inserted into a female receptacle of an electrical connector in accordance with the present invention.

As shown in FIG. 5, once the male portion is inserted into the female receptacle, the setscrew 20 is tightened with an Allen wrench or the like, thereby forcing the top surface of the male portion connector housing 52 towards the electrical pins 18. Compression of the connector core 50 in the male portion 12 causes the pins 18 in the female receptacle 14 to engage the conductive pads 60 on the ends of the de-insulated conductors 17 (or the de-insulated conductors 17 directly) to form individual electrical connections. Each electrical pin 18 has a stepped diameter so that the downward pressure of the setscrew does not force the pin through the rigid bottom surface 30 of the female receptacle 14. As can be seen, the setscrew 20 is electrically isolated from the electrical pins 18 by the connector housing 52 and the pliable insulating elastomeric sheet 50. In order to remove the male portion 12 from the female receptacle, the surgeon unscrews the setscrew 20, thereby releasing pressure on the connector housing 52 such that the surgeon can withdraw the male portion 12 from the female receptacle 14.

Figure 6:
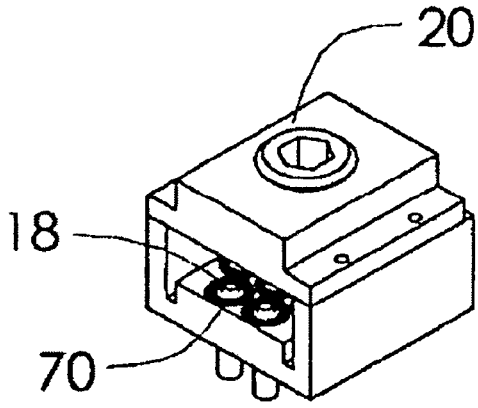
FIG. 6 is an isometric view of a female receptacle of the electrical connector of the present invention.

FIGS. 5 and 6 respectively show in section view and in isometric projection view a number of seals 70 with concentric sealing ridges that surround each of the electrical pins 18 in the female receptacle 12 of the connector. As indicated above, to ensure good electrical isolation between different electrical pins 18, the seals 70 prevent continuity in fluids that may seep inside the connector housing and around the pins 18. The seals 70 are preferably molded into the bottom surface of the female receptacle 14 with rigid concentric rings that engage and deform the pliable silicone sheet 50 due to compression by the setscrew 20.

Figure 7:
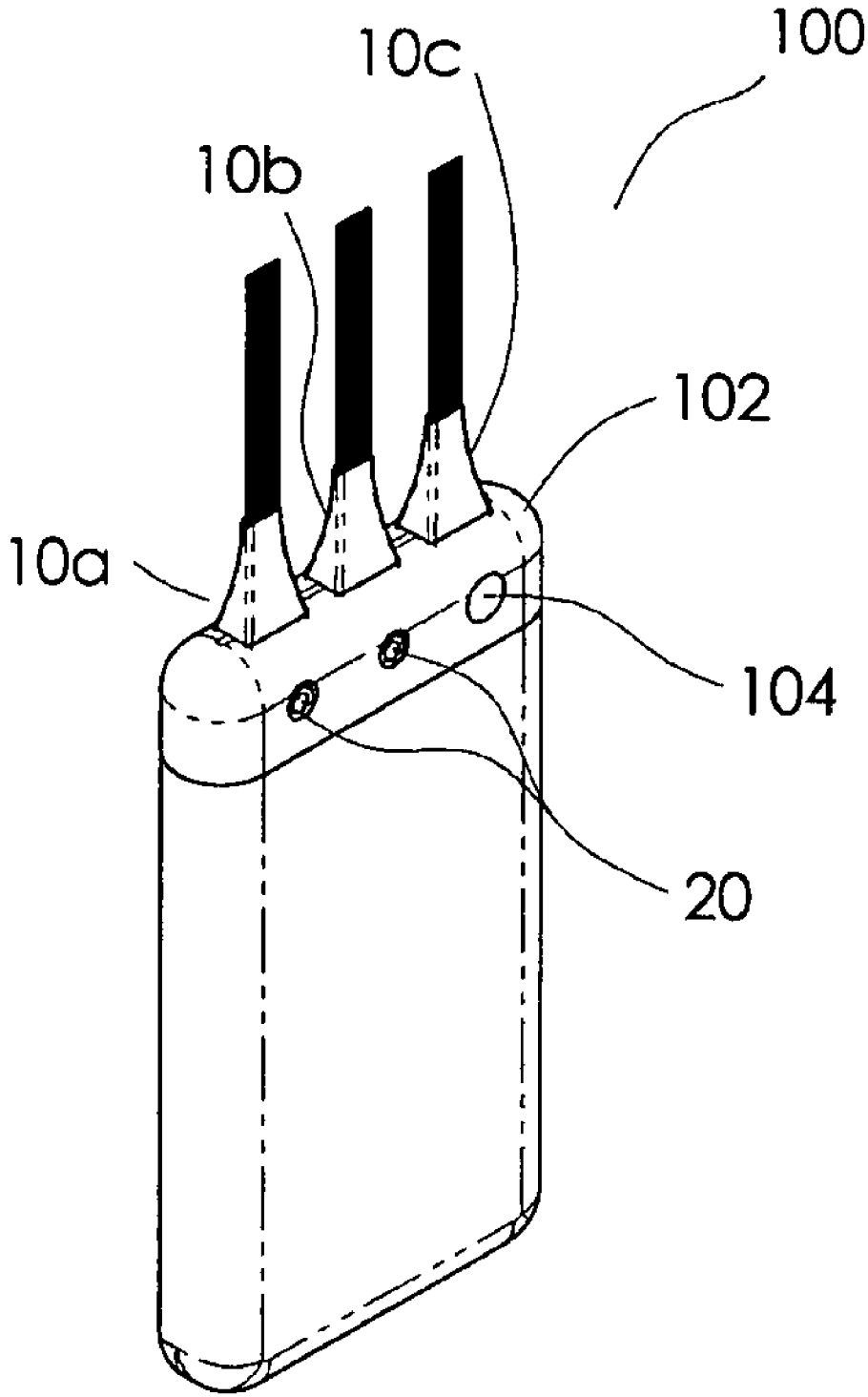
FIG. 7 illustrates an implantable medical device including a plurality of electrical connectors in accordance with the present invention.

FIG. 7 shows an implantable electrical stimulation device, including a number of electrical connector systems 10*a*, 10*b*, 10*c* that serve as bridges between individual sensors, electrodes or antennae and the control unit in accordance with the present invention. Each of the female receptacles that receive the male portions of connectors 10*a*, 10*b*, 10*c* can be molded into a header 102 found on the device 100. Preferably, a cap or cover 104 is placed into each setscrew hole to cover each setscrew in the header to prevent tissue from growing into the area of the setscrews. The male portion of a connector can be easily removed from the device by removing the cap 104 and engaging an Allen key or equivalent tool to loosen the setscrew 20.

Figure 8:
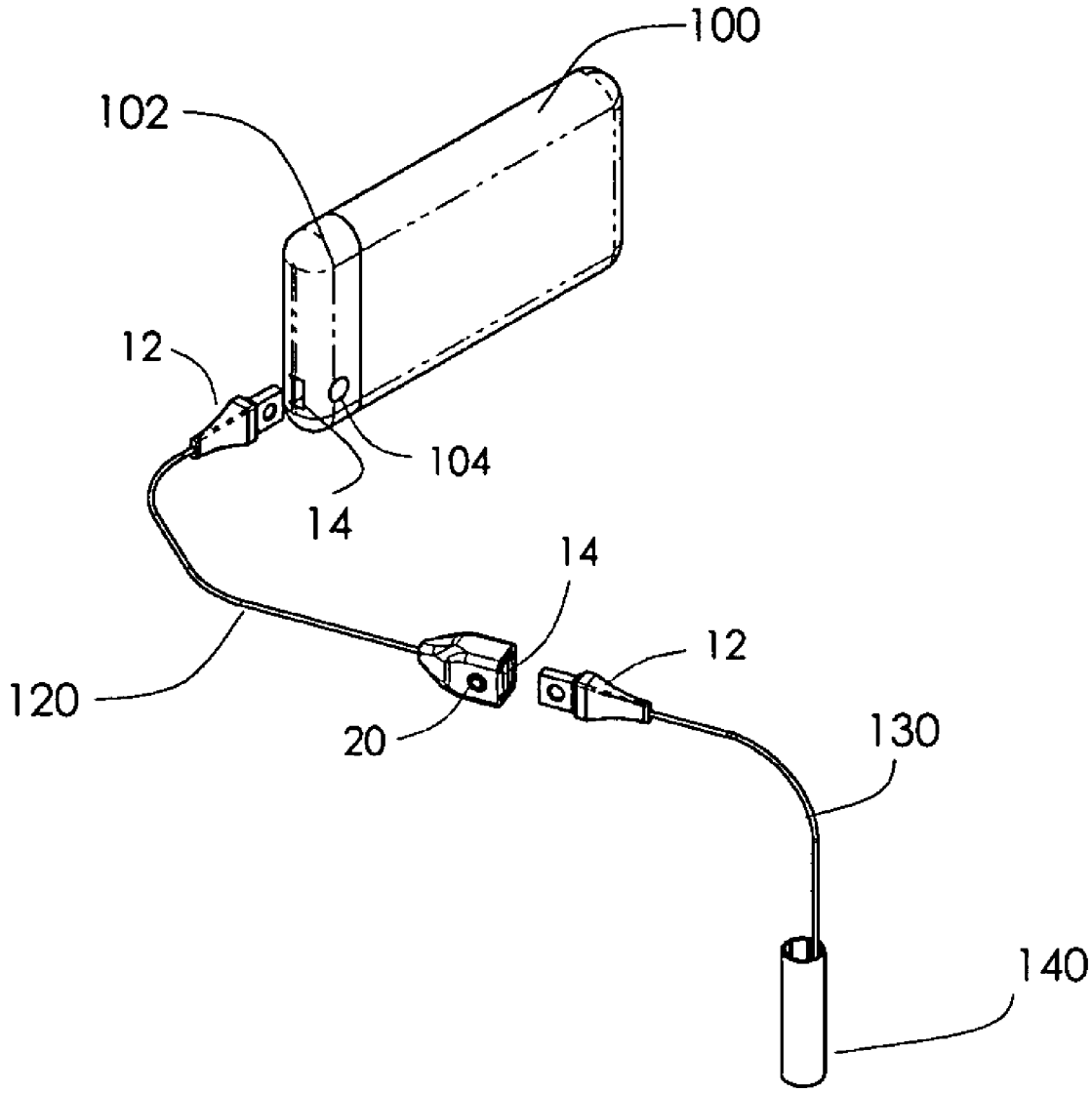
FIG. 8 illustrates how the electrical connector male portion and female receptacle of the present invention can be used in-line to form an implanted multi-wire lead extension cable.

FIG. 8 shows an alternative use of the implantable connector system in the form of an implantable lead extension comprising a male portion 12 at one end of a flexible cable 120 and a female receptacle 14 at the other end of flexible cable 120. In this embodiment the male portion 12 of lead extension cable 120 is connected to a female receptacle 14 embedded in the header 102 of an implantable medical device 100, and the female receptacle 14 at the other end of lead extension cable 120 receives a male connector portion 12 that is connected via a flexible cable 130 to a nerve cuff device 140.

While several preferred embodiments of the invention have been illustrated and described, it will be appreciated that various changes can be made therein without departing from the scope of the invention. Therefore, the scope of the invention is to be determined from the following claims and equivalents thereto.

The embodiments of the invention in which an exclusive property or privilege is claimed are defined as follows:

1. An electrical connector comprising:

a male portion including:

a plurality of conductive pads that terminate thereon;

a housing having exterior surface guides;

a compressible insulating member positioned between the conductive pads and the housing;

a female receptacle including:

a first and second stationary opposite walls defining a cavity therebetween for receiving the male portion;

an opening between the first and second walls, the opening having dimensions sufficient to enable the insertion of the male portion into the cavity through the opening;

interior surface guides that cooperate with the exterior surface guides of the male portion to guide the insertion of the male portion in a direction parallel to the first and second walls to a final position in the cavity;

a number of conductive members positioned on an inner surface of the first wall; and a locking mechanism positioned on the second wall to compress the conductive pads in the male portion against the conductive members in the female receptacle and lock the male portion in the final position in the cavity;

wherein in operation the male portion is inserted through the opening to the final position in the cavity such that the conductive pads align with the conductive members and the male portion is locked into the final position using the locking mechanism.

2. The electrical connector of claim 1, wherein the locking mechanism is electrically isolated from the plurality of conductive pads.

3. The electrical connector of claim 1, wherein the locking mechanism comprises a setscrew.

4. The electrical connector of claim 1, wherein the conductive pads in the male portion are insulated but have a portion of an insulating material removed where the conductive members engage the conductors.

5. The electrical connector of claim 1, wherein the conductive pads in the male portion are arranged in flat, planar array.

6. The electrical connector of claim 1, wherein the external surface guides of the male portion include fins that cooperate with the interior surface guides of the female receptacle.

7. The electrical connector of claim 1, wherein the conductive members are conductive pins.

8. The electrical connector of claim 7, wherein the conductive pins extend through holes in the inner surface of the first wall, wherein each hole has a seal that surrounds the conductive pin.

9. The electrical connector of claim 8, wherein the seals are rigid and engage a compressible insulating member in the male portion under compression of the locking mechanism.

10. The electrical connector of claim 7, wherein the conductive pins within the female receptacle are stepped at one end thereof.

11. The electrical connector of claim 1, wherein the interior surface guides of the female receptacle include the first and second walls.

12. The electrical connector of claim 1, wherein the exterior surface guides of the male portion include the housing.

13. An electrical connector comprising:

a male portion having a plurality of electrical conductors that terminate thereon and a compressible insulating member;

a female receptacle including;

a first and second opposite walls defining a cavity therebetween for receiving the male portion;

an opening between the first and second walls, the opening having dimensions sufficient to enable the insertion of the male portion into the cavity through the opening;

a number of conductive members on an inner surface of the first wall, each of the conductive members being surrounded by an individual rigid seal; and a locking mechanism positioned on the second wall to compress the electrical conductors in the male portion against the conductive members in the female receptacle and compress the rigid seals between the first wall and the compressible insulating member in the male portion so as to provide electrical insulation and lock the male portion in the cavity;

wherein in operation the male portion is inserted through the opening and locked in the cavity using the locking mechanism.

14. The electrical connector of claim 13, wherein the conductive members are conductive pins.

15. The electrical connector of claim 14, wherein the conductive pins within the female receptacle are stepped at one end thereof.

16. The electrical connector of claim 14, wherein the conductive pins extend through holes in the inner surface of the first wall.

17. The electrical connector of claim 13, wherein the locking mechanism is electrically isolated from the plurality of electrical conductors.

18. The electrical connector of claim 13, wherein the locking mechanism comprises a setscrew.

19. The electrical connector of claim 13, wherein the male portion includes a housing and a plurality of conductive pads secured to the electrical conductors, wherein the conductive pads align with the conductive members when the male portion is within the female receptacle.

20. The electrical connector of claim 19, wherein the compressible insulating member is positioned between the conductive pads and the housing of the male portion.

21. The electrical connector of claim 13, wherein the electrical conductors in the male portion are insulated but have a portion of an insulating material removed where the conductive members engage the conductors.

22. The electrical connector of claim 13, wherein the electrical conductors in the male portion are arranged in flat, planar array.

23. The electrical connector of claim 13, wherein the rigid seals are integral with the inner surface of the first wall.

24. The electrical connector of claim 23, wherein the rigid seals are concentric rings.

25. An electrical connector comprising:

a male portion having a plurality of electrical conductors that terminate thereon and exterior surface guides, a female receptacle including:

a first and second stationary opposite walls defining a cavity therebetween for receiving the male portion;

an opening between the first and second walls, the opening having dimensions sufficient to enable the insertion of the male portion into the cavity through the opening;

interior surface guides that cooperate with the exterior surface guides of the male portion to guide the insertion of the male in a direction parallel to the first and second walls to a final position in the cavity;

a number of conductive pins extending through holes in the inner surface of the first wall, each hole having a rigid seal that surrounds the conductive pin;

and a locking mechanism positioned on the second wall to apply the conductors in the male portion against the conductive members in the female receptacle and lock the male portion in the final position in the cavity;

wherein in operation the male portion is inserted through the opening to the final position in the cavity such that the rigid seals engage a compressible insulating member in the male portion under compression of the locking mechanism and the male portion is locked into the final position using the locking mechanism.

* * * * *